United States Patent [19]

Killer et al.

[11] Patent Number: 4,674,692

[45] Date of Patent: Jun. 23, 1987

[54] MIXING AND/OR COMMINUTING APPARATUS

[75] Inventors: Walter Killer, Zürich; Hans Riniker; Alfred Gloor, both of Rupperswil, all of Switzerland

[73] Assignee: Dr. Killer Verfahrenstechnik, Rupperswil, Switzerland

[21] Appl. No.: 869,086

[22] Filed: May 30, 1986

[30] Foreign Application Priority Data

May 31, 1985 [DE] Fed. Rep. of Germany ..... 3519613

[51] Int. Cl.[4] ..... B02C 19/00

[52] U.S. Cl. ..... 241/98; 241/101 B; 241/199.12; 241/206

[58] Field of Search ..... 241/66, 98, 101 B, 172, 241/38, 189 R, 41, 191, 192, 193, 199.12, 204, 206; 366/297, 298, 299, 300

[56] References Cited

U.S. PATENT DOCUMENTS

| | | | |
|---|---|---|---|
| 1,475,638 | 11/1923 | Low | 366/300 |
| 3,743,192 | 7/1973 | Otto | 241/101 B |
| 4,506,838 | 3/1985 | Riniker et al. | 241/101 B X |

*Primary Examiner*—Timothy V. Eley

[57] ABSTRACT

A mixing and/or comminution apparatus is described in which a nozzle arrangement which can be supplied with suckable and/or pumpable media is provided in the region of a stirrer member which rotates within the apparatus around the wall thereof. The nozzle arrangement extends over the axial length of the stirrer member and rotates together with the stirrer member.

12 Claims, 1 Drawing Figure

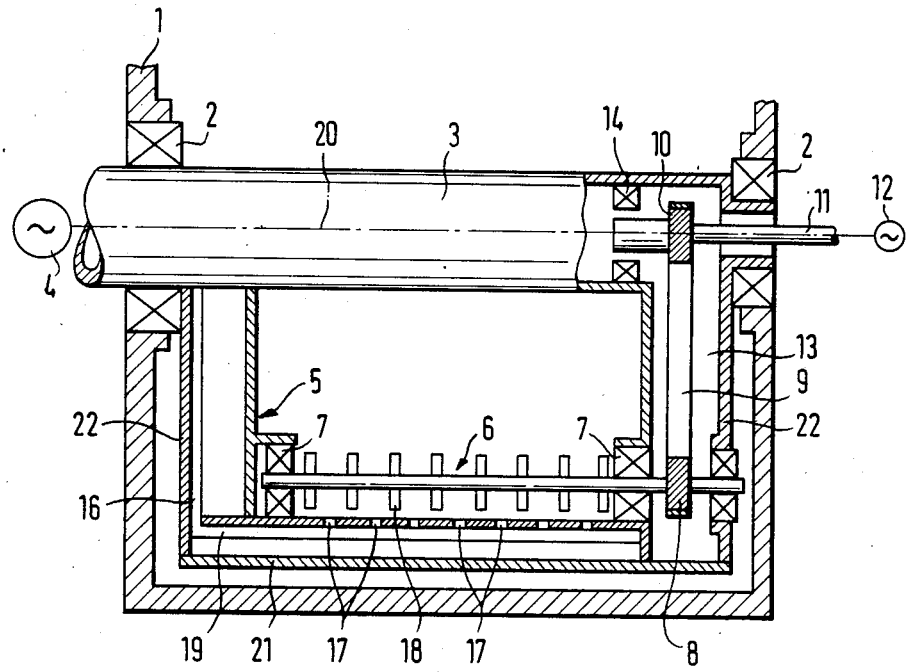
1
2
20
3
14
10
2
12
11
4
13
9
22
5
7
6
7
22
16
19
21
17
18
17
8

MIXING AND/OR COMMINUTING APPARATUS

BACKGROUND OF THE INVENTION

The invention relates to mixing and/or comminuting apparatus comprising a cylindrical container for receiving the material to be treated; at least one drivable stirring member which is concentrically journalled relative to the container axis and which extends substantially up to the inner wall region of the container; and also at least one tool which is eccentrically and rotatably journalled relative to the container axis, which rotates with the stirrer member and which acts on the stirred material, with the tool being drivable with a speed of rotation and/or direction of rotation which are the same as or different from the speed of rotation and/or direction of rotation of the stirrer member (U.S. Pat. No. 4,506,838).

When manufacturing many goods which are required for industrial and private needs it is necessary to mix various substances with one another. In a whole series of cases it is also necessary to bring about a chemical reaction in the mixed material. Troublefree mixing is in particular made additionally difficult when, in known manner, a liquid medium is to be introduced by a lance type spray nozzle. The danger of material balling together and forming lumps is in this case particularly great.

SUMMARY OF THE INVENTION

The object underlying the invention is to so construct an apparatus of the initially named kind in the simplest possible manner so that even when the requirement exists to carry out "in-spray processes" ideal treatment of the material and an extremely uniform process product is obtained, for example a granulate, independent of the composition and the instantaneous state of the material to be treated, while obtaining a short throughput or processing time.

This object is satisfied in accordance with the invention in that a nozzle arrangement to which suckable or pumpable media can be supplied is provided in the region of at least one wall-side element of the stirrer member, rotates with the stirrer member, and extends at least substantially over the axial length of the stirrer member.

This arrangement and layout of the nozzle arrangement brings a surprisingly uniform distribution of the particular material which is sprayed into the product, with the stirring and spraying processes evidently mutually aiding one another in such a way that an unexpectedly favourable result is obtained.

The nozzle arrangement preferably consists of a tube or pipe which extends parallel to the wall-side element of the stirrer member and which is provided with wall openings or with spray nozzles.

The wall-side element of the stirrer member preferably consists of a stirrer vane, with the nozzle pipe being integrated in the stirrer vane. An embodiment in which the nozzle pipe is arranged in the region of that stirrer vane with which a tool is associated, in particular a tool in the form of a chopper, is particularly advantageous. This results in an additional mixing effect and simultaneously in an improvement of the chopping effect. Despite the operating conditions which are made more difficult by the spraying in of material it is possible with this embodiment to achieve a minimisation of the throughput time while achieving a high quality of the product of the process.

The nozzle tube is preferably pivotably mounted so that the angle at which the particular medium is sprayed, which material can be a liquid or a vapor, can be matched to the prevailing conditions in the sense of optimising the process.

Further advantageous developments of the invention are set forth in the subordinate claims.

An embodiment of the invention will now be explained in the following with reference to the drawing, the single FIGURE of which shows a schematic sectional representation of an embodiment of the apparatus of the invention.

As seen in the drawing a stirrer member 5 is arranged in a cylindrical container 1 and is rotationally fixedly connected to a support shaft 3 which is rotatably mounted by means of bearings in the container concentric to the container axis 20. The stirrer member 5 is formed as a frame-like arrangement which extends substantially up to the inner wall region of the container 1. The frame-like stirrer member includes at least one part 21 which extends parallel to the container axis 20 and which is preferably designed as a stirrer vane, and also two lateral, radially extending support parts 22.

A chopper 6 which acts on the material to be treated is rotatable mounted radially inside the wall-side part 21 of the stirrer member 5 on the two lateral or end support parts 22 by means of bearings 7.

In addition to a first drive 4 for the stirrer member 5 a second drive 12 independent from the first drive is provided for the chopper 6. The output drive shaft 11 of the second drive or drive motor 12 is rotatably journalled in the support shaft 3 for the stirrer member 5 by means of bearings 14 and is connected with the chopper 6 via a schematically illustrated transmission 8, 9, 10, in the present case a belt transmission, which is shown as an example. The transmission is accommodated in a hollow chamber 13 of the right hand end support part 22 for the stirrer member 5. The hollow chamber 13 is sealed with this arrangement in such a way that penetration of the material to be treated into the hollow cavity on the one hand and the emergence of lubricant from the hollow cavity on the other hand is prevented.

A tube 19 connected with the stirrer vane 21, or integrated into the stirrer vane, is schematically shown in the drawing. A plurality of nozzle openings 17 are formed in the wall of the tube. This nozzle tube 19 is fed with a liquid or vapor-like medium via a supply pipe 16 extending within the stirrer member.

The nozzle pipe can be mounted in the region of the upper or rear side of the stirrer vane and is preferably freely rotatable so that the spray angle of the liquid to be sprayed or of the vapor to be introduced can be varied in accordance with the prevailing circumstances.

The nozzle tube which extends over the full axial length of the stirrer vane is preferably positioned in such a way that the medium emerging via the nozzles 17 passes directly into the region of influence of the chopper 6 adjacent the vane which results, on the one hand, in an additional mixing effect and, on the other hand, allows a more uniform granulate to be achieved as a consequence thereof.

By means of the apparatus of the invention a more economical process results if one solvent is to be replaced with another.

Thus a decisive and unexpected increase in the operating efficiency of the apparatus is achieved by a constructionally simple measure.

We claim:

1. Mixing and/or comminution apparatus comprising a cylindrical container for receiving the material to be treated; said container having an inner wall; at least one drivable, rotatable stirrer member which is concentrically journalled relative to the container axis and which extends substantially up to the inner wall region of the container; said stirring member having at least one wall-side element; and also at least one tool which is eccentrically and rotatably journalled relative to the container axis, which rotates with the stirrer member; said stirrer member acting on the material to be stirred, and the tool being drivable with a speed of rotation and/or direction which are independent from those of the stirrer member, characterised in that a nozzle arrangement (17,19) to which suckable or pumpable media can be supplied is provided in the region of said at least one wall-side element (21) of the stirrer member (5), and which rotates with the stirrer member and extends at least substantially over the axial length of the stirrer member.

2. Apparatus in accordance with claim 1, characterised in that the nozzle arrangement comprises a tube (19) with wall openings (17) which extends parallel to the wall-side element (21) of the stirrer member (5).

3. Apparatus in accordance with claim 2, characterised in that the tube (19) is equipped with a plurality of spray nozzles.

4. Apparatus in accordance with claim 2, characterised in that the nozzle tube (19) is combined with the wall-side element (21) of the stirrer member (5) into a unit.

5. Apparatus in accordance with claim 4, characterised in that the wall-side element (21) of the stirrer member consists of a stirrer vane, with the nozzle tube (19) being integrated into the stirrer vane.

6. Apparatus in accordance with claim 2, characterised in that the nozzle tube (19) is arranged in the region of the stirrer member with which the tool is associated, with the tool in particular being constructed as a chopper.

7. Apparatus in accordance with claim 6, characterised in that the nozzles (17) are directed such that the respective media is sprayed directly into the immediate working range of the chopper.

8. Apparatus in accordance with claim 2, characterised in that the nozzle tube (19) is pivotably mounted.

9. Apparatus in accordance with claim 2, characterised in that the nozzle tube (19) is fed via bores and/or lines (16) in the container axle (20) and in the stirrer member (5).

10. Apparatus in accordance with claim 1, characterised in that pumpable, in particular liquid or vapor-like media is used as the media which is to be introduced through the nozzles.

11. Mixing and comminution apparatus comprising a container for receiving material to be treated, said container having a side wall, first and second end walls and an axis; at least one drivable stirrer disposed within said container, said drivable stirrer having a drive shaft with an axis of rotation coaxial to said container axis, first and second arms extending radially away from said axis of rotation parallel to said first and second end walls of said container and a stirrer element interconnecting said arms and extending substantially parallel to said side wall; a rotatable material processing tool extending parallel to said stirrer element and having first and second ends; bearing means at each of said radially extending arms for supporting said first and second ends of said material processing tool; first drive means for rotating said drive shaft whereby to rotatably drive said stirrer element about said axis of rotation within said container at a first speed of rotation; second drive means for rotating said rotatable material processing tool at a second speed of rotation selectable independently of said first speed of rotation, said second drive means comprising a drive axle extending coaxially to said drive shaft and a transmission connecting said drive axle to said tool, wherein said second arm is hollow and wherein said transmission is located in said hollow second arm; the apparatus further comprising a duct extending between said first and second arms adjacent and substantially parallel to said stirrer element, a plurality of spaced apart nozzles communicating with said duct for spraying one of a vapor and a liquid into said container in the immediate vicinity of said material processing tool, and conduit means connecting said duct with one of a source of liquid and a source of vapor disposed outside of said container.

12. Apparatus in accordance with claim 11, wherein said conduit means comprises a first duct element disposed within one of said first and second arms, a second duct element extending through the said drive shaft for said drivable stirrer and communicating with said first duct element, and rotatable joint means disposed between said source and said duct, preferably between said source and said first duct element.

* * * * *